US007165501B2

(12) United States Patent
Woomer

(10) Patent No.: US 7,165,501 B2
(45) Date of Patent: Jan. 23, 2007

(54) SAIL CONVERSION KIT AND METHOD FOR SMALL WATERCRAFT

(76) Inventor: Thomas L. Woomer, 18185 SR 550, Marietta, OH (US) 45750

( * ) Notice: Subject to any disclaimer, the term of this patent is extended or adjusted under 35 U.S.C. 154(b) by 0 days.

(21) Appl. No.: 10/949,273

(22) Filed: Sep. 24, 2004

(65) Prior Publication Data

US 2006/0065176 A1 Mar. 30, 2006

(51) Int. Cl.

| | |
|---|---|
| ***B63B 35/71*** | (2006.01) |
| ***B63B 15/02*** | (2006.01) |
| ***B63B 39/00*** | (2006.01) |
| ***B63H 9/00*** | (2006.01) |
| ***B63H 25/06*** | (2006.01) |

(52) U.S. Cl. ..... 114/39.22; 114/39.32; 114/140; 114/162; 114/347; 114/364

(58) Field of Classification Search ..... 114/39.21, 114/39.22, 39.29, 39.32, 90, 91, 127, 140–143, 114/343, 364, 39.12, 39.15, 162, 168, 347
See application file for complete search history.

(56) References Cited

U.S. PATENT DOCUMENTS

| | | | | | |
|---|---|---|---|---|---|
| 2,531,549 | A | * | 11/1950 | Boyd | 114/345 |
| 3,041,994 | A | | 7/1962 | Brodie | |
| 3,139,057 | A | * | 6/1964 | Black | 114/43 |
| 3,349,741 | A | | 10/1967 | Herbst | |
| 3,601,076 | A | * | 8/1971 | Meeks | 114/39.22 |
| 3,777,690 | A | | 12/1973 | Garber | |
| 3,902,443 | A | | 9/1975 | McDougall | |
| 4,061,100 | A | * | 12/1977 | Muhlfeld | 114/43 |
| 4,082,049 | A | | 4/1978 | Nicol | |
| 4,597,348 | A | * | 7/1986 | Jonas | 114/140 |
| 4,641,594 | A | | 2/1987 | Birkett | |
| 4,646,669 | A | | 3/1987 | Frank | |
| 4,751,889 | A | | 6/1988 | Pool | |
| 4,789,368 | A | * | 12/1988 | D'Onofrio | 441/79 |
| 4,809,629 | A | | 3/1989 | Martinmaas | |
| 4,825,790 | A | * | 5/1989 | Strout | 114/39.32 |
| 4,958,582 | A | | 9/1990 | Vermillion et al. | |
| 5,289,792 | A | | 3/1994 | Forrest et al. | |
| 5,657,713 | A | | 8/1997 | Rowlett | |

(Continued)

FOREIGN PATENT DOCUMENTS

| | | | |
|---|---|---|---|
| DE | 1186357 | A * | 1/1965 |

(Continued)

*Primary Examiner*—Ajay Vasudeva
(74) *Attorney, Agent, or Firm*—Hahn Loeser & Parks LLP

(57) ABSTRACT

An assembly for converting a non-sailing boat to a sailboat comprises a sailing keel adapted to be removably attached to the keel of a boat, a first and a second support frame, one or more straps connected on a first end to the sailing keel and connected on a second end to one or both of the first and second support frames, a steering support frame, and a rudder attached to the steering support frame or stern of the boat. The first and second support frames and steering support frame are adapted to extend across the boat from one side of the boat to an opposite side, and the first support frame is adapted to support a mast in an essentially vertical position. A method for converting a non-sailing boat to a sailboat utilizing this assembly is also provided.

13 Claims, 5 Drawing Sheets

U.S. PATENT DOCUMENTS 6,035,799 A * 3/2000 Lukanovich et al. ..... 114/343
6,390,013 B1 5/2002 Cornell
6,457,430 B1 10/2002 Drabkin

FOREIGN PATENT DOCUMENTS

DE 29919234 U1 * 2/2000
EP 125231 A1 * 11/1984
FR 2594785 A1 * 8/1987
JP 60199786 A * 10/1985
JP 01278897 A * 11/1989

* cited by examiner

SAIL CONVERSION KIT AND METHOD FOR SMALL WATERCRAFT

This invention relates to a conversion system and methods for converting small watercraft. More particularly, this invention relates to an improved kit and methods to convert a non-sailing boat to a sailboat having.

BACKGROUND OF THE INVENTION

Small watercraft such as canoes, rowboats, kayaks, small sailboats and the like are widely used for recreational purposes. It has been recognized that at times it may be desirable to be able to convert a non-sailing boat, such as a canoe or rowboat, into a sailboat. This conversion may be motivated by only occasional use of a boat as a sailboat, such that separate purchase of a sailboat and a non-sailing boat is not desirable.

Numerous attempts have been made to provide a conversion kit for conversion of a canoe, rowboat, or other non-sailing vessel to a sailing vessel, but such attempts have not resulted in an effective, easily used system. Known kits are generally difficult to use, do not provide proper handling of the vessel upon conversion to a sailing vessel, and may necessitate material revision to the canoe, boat or kayak itself. Several such systems are provided in the patent literature. For example, U.S. Pat. No. 3,349,741 to Herbst provides a surfboard with a sail propulsion apparatus featuring a sail and leeboard assembly. The surfboard is controlled by pivotally connected leeboards attached to the base on opposite sides of the watercraft. U.S. Pat. No. 3,041,994 to Brodie teaches a kit sail for a boat, such as a canoe, wherein the kit includes a sail assembly, a rudder assembly as well as a pair of leeboards associated with the sailing assembly.

U.S. Pat. No. 6,457,430 to Drabkin teaches an apparatus that can enable the conversion of a small boat, such as a kayak, a canoes or a skiff, to a sailing vessel. With this apparatus, the conversion from a non-sailing to a sailing vessel may be accomplished with out requiring boaters to move from their usual positions. The system, however, also uses a leeboard for control.

A leeboard is also used with a mast, sail support, hiking seats and a rudder assembly in the kit provided by U.S. Pat. No. 4,646,669, which provides for the conversion of a small boat, such as a canoe, into a sailboat.

A sailing frame that is mountable on an inflatable or other boat is provided by U.S. Pat. No. 4,082,049 to Nicol. The sailing frame can be disassembled and/or folded for storage, and consists of a mounting for a sail, a rudder and bilge boards that extend vertically from the sides of the boat.

A kit for the conversion of a kayak to a sailing boat is provided by U.S. Pat. No. 6,390,013 to Cornell. The portable kit consists of a lightweight bi-pod mast, which may be mounted to a removable board/hatch at the front of the kayak. Also, a leeboard kit is included to attach to the side of the cockpit of the open-trough kayak.

A system for adapting two canoes or similar boats into a single sailing vessel is provided by U.S. Pat. No. 5,657,713 to Rowlett. The system provides bow and stern connecting members between two open-hulled boats. A sail is mounted to a connecting member, and a centerboard mount and a rudder mount are also provided. A board extends downward from a mount between the two canoes.

The use of outriggers or pontoons is well known in kits for conversion of a canoe or similar boat to a sailboat. One such kit is provided by U.S. Pat. No. 4,641,594 to Birkett. This kit includes a lightweight, rectangular frame, a front and rear crossbar and pontoons or ice runners extending from the front crossbar. Similarly, U.S. Pat. No. 3,902,443 to McDougall teaches a sail and stabilizer float kit for use with a small boat. The kit comprises a pair of out-rigger floats. A pair of leeboards provides added stability. Additionally, U.S. Pat. No. 3,777,690 to Garber teaches a sailing-stabilizing outrigger which supports a mast and sail.

The prior kits and methods for converting a canoe or similar small watercraft using various outriggers or leeboards that extend downward from the top of the gunnel to attempt to provide lateral stability. These prior conversion devices, however, do not provide the desired amount of control and stability, and as a result, the performance of the converted boat does not necessarily mimic the performance of a traditional sailboat. Therefore, there is a need for an assembly for reversibly converting a small non-sailing watercraft, such as a canoe or the like, to a sailboat, where the converted boat is configured more like a typical sailboat, providing desired stability and control in an easily used system. There also is a need for a conversion kit and methods which allow the user to effectively convert a non-sailing vessel to a sailing vessel in a simple fashion without modifying the vessel in any manner.

SUMMARY OF INVENTION

It is, therefore, an aspect of the present invention to provide a system and a method for reversible conversion of a small non-sailing watercraft to a sailboat, wherein the system is easily adapted to the non-sailing watercraft. The system and method utilize a keel assembly, a rudder assembly and a mast assembly. The keel assembly comprises a detachable weighted sailing keel selectively mounted to extend from the bottom of the watercraft. The mast assembly is selectively mounted to the non-sailing watercraft at a predetermined position relative to the keel assembly, and the rudder assembly mounted near the rear of the watercraft to provide desired control in a sailing mode. By "small watercraft", the present invention contemplates boats or other watercraft that are ordinarily capable of being powered by hand, especially by paddling or rowing. This includes boats, canoes, kayaks and the like, that ordinarily carry no more than about 12 passengers for example.

In general, the present invention provides a system and methods for converting a non-sailing boat to a sailboat. In an embodiment, the system comprises a sailing keel adapted to be selectively attached to the keel or bottom portion of a non-sailing boat. A first and a second support frame are mounted to the boat, and one or more fastening members connect the sailing keel to the support frames to retain the sailing keel on the boat. The fastening members may be straps extending around a portion of the sailing keel and connected on opposing ends of the first and second support frames. A mast assembly supports a conventional sailing mast and sail, at a desired location relative to the keel assembly and supports. A rudder assembly comprises a steering support frame and a rudder attached to the steering support frame. The steering support frame and the first and second support frames are adapted to adjustably extend across the boat from one side of the boat to the opposite side, and the a support frame may be adapted to support a mast in an essentially vertical position. The present invention likewise provides a boat that includes this system.

The present invention likewise provides a method for converting a non-sailing boat to a sailboat. The method comprises providing a sailing keel adapted to be removably attached to the bottom of a non-sailing boat, providing a first and a second support frame, wherein the first and second support frames are adapted to extend across a boat from one side of the boat to an opposite side, and wherein the first support frame is adapted to support a mast in an essentially vertical position. One or more straps are used for connecting the sailing keel to one of the first and second support frames. The method further provides a steering support frame adapted to be mounted across a boat from one side of the boat to the other and carrying a rudder. The first and second support frames and the steering support frame are removably attached to a non-sailing boat, and a mast is coupled with the first support frame to provide a converted sailboat.

PREFERRED EMBODIMENT FOR CARRYING OUT THE INVENTION

Figure 1:
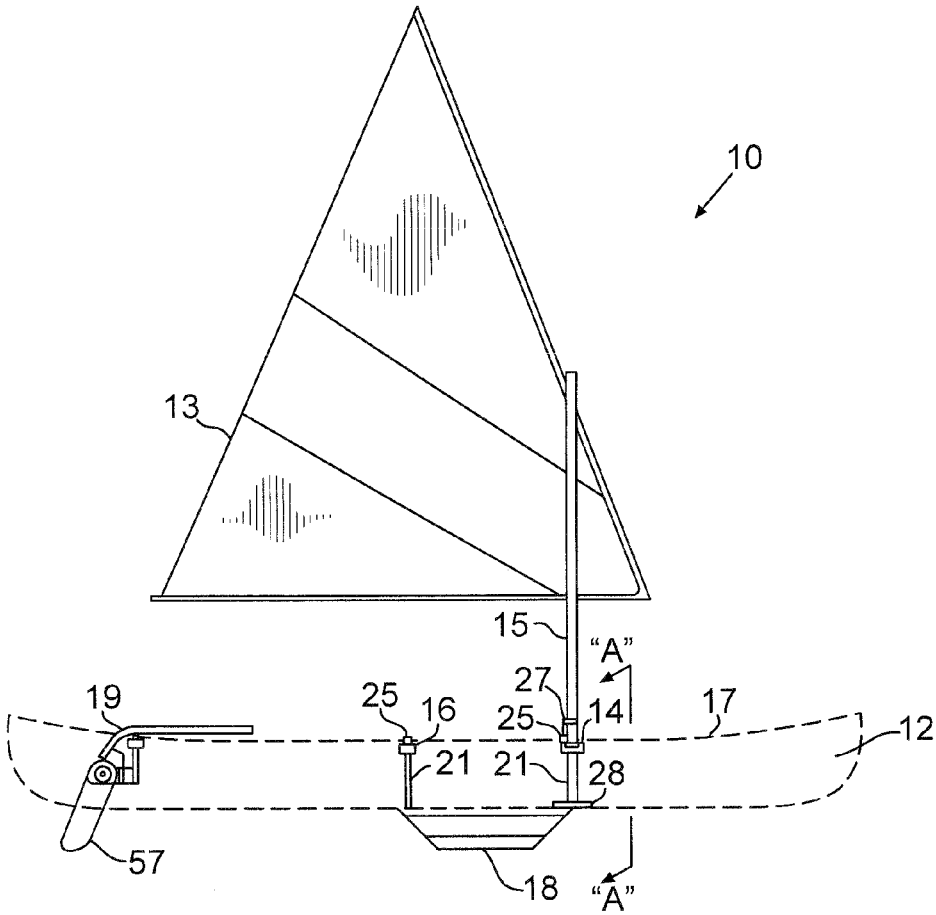
FIG. 1 is a side elevational view of the assembly of the present invention in use with a canoe.

The present invention is directed toward a system and method for converting a canoe or other small watercraft to a sailboat. Turning to the Figures, FIG. 1 shows the conversion system 10 generally in association with a canoe 12. The system 10 includes a plurality of assemblies, which are selectively mounted in association with the watercraft 12 for converting it from a non-sailing mode of operation to a sailing mode. In general, the system comprises a sail assembly, which may be a conventional sail and mast, such as used for known sailboats. As an example, the sail assembly may include a single sail 13, such as used on smaller sailboats. The sail assembly further includes a mast 15 for supporting the sail at an elevated position relative to the watercraft 12. Each of the assemblies used to convert the watercraft 12 are selectively attachable to the boat 12 for sailing, and easily removed for use of the boat 12 in the normal fashion. The system 10 adapts the boat 12 for sailing without any modification or alteration of the boat 12. Further, the system 10 is readily adaptable to various sized and configured watercraft, and thus may be effectively used with differing types of smaller vessels.

In general, the system 10 includes a weighted sailing keel or centerboard assembly, a mast support assembly and a rudder assembly. The sailing keel assembly is removably mounted to the bottom of the boat. The sailing keel assembly also includes a pair of support frames, extending across the boat from one side of the boat to the other. The sailing keel is attached to the frames by a number of fasteners, such as straps. The front and rear support frames provide proper placement of the sailing keel relative to both the mast and the boat as a whole. The purpose of keel or centerboard assembly is to provide resistance to making leeway, to effectively keep the yacht from sliding sideways through the water due to wind pressure on the sails. This assembly will be described in more detail in accordance with an embodiment thereof, but it should be recognized that various shapes of keel or centerboard may be used in conjunction with the invention.

Optimally, the front and rear frames are adjustable to fit a variety of canoes or similar vessels. Once positioned in their proper place, the front and rear frames are secured to the sides of the boat, preferably at the gunnels, and the straps extending from the front and rear frames to the keel are tightened. The mast is placed through an opening in one of the frames, preferably the front frame, and rests in a mast-seating device or "boot" positioned on the floor of the boat. The mast is secured in place to the frame.

The system 10 may also include a steering system that may include a rudder and rudder support system. The steering support frame may be attached to the sides of the boat, preferably at the gunnels. Like the front and rear frames, the steering support frame is also preferably adjustable to fit a variety of types and sizes of boats. The steering support frame may extend past one side of the boat to provide an attachment for a rudder. The rudder may be pivotally attached to the frame to permit the rudder to be moved from side to side to steer the boat and to be moved from a generally vertical position to a more horizontal one, for example, during beaching of the canoe or to avoid submerged obstacles.

The system and method of the present invention will be described in more detail relative to the figures. The following example should not be viewed as limiting the scope of the invention, and only the claims will serve to define the invention.

Figure 2:
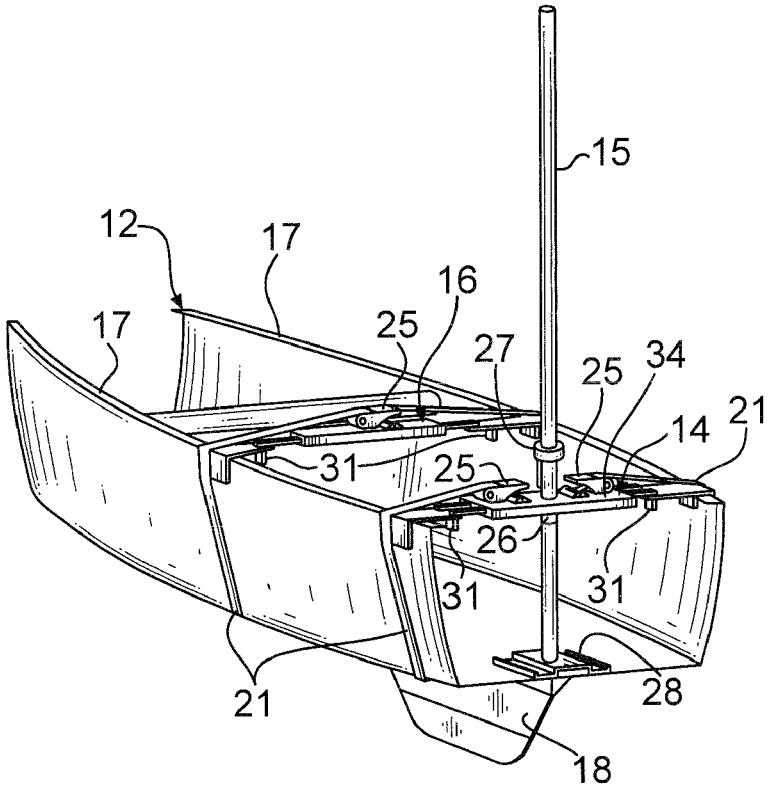
FIG. 2 is a perspective view, cut away along line A—A in FIG. 1.

The general configuration of the system 10 as shown in FIG. 1 indicates the general positioning of the assemblies with respect to the boat 12. Conversion to a sailing mode may be performed by attaching front support frame 14 and rear support frame 16 to canoe 12, preferably at the gunnels 17. If the vessel 12 does not have gunnels, other appropriate structure for fastening the support frames 14 and 16 to the boat 12 are contemplated. In the embodiment shown, the gunnels serve as a mounting structure which cooperates with portions of the supports 14 and 16 to secure the supports to each side of the boat as seen in FIG. 2. Support frames 14 and 16 extend from one side of canoe 12 to the other through or just above the interior of canoe 12. Similarly, supports 14 and 16 extend across a first upper edge located on one side of boat 12 to a second upper edge located on an opposite side of the boat. Typically, support frames 14 and 16 will be adjustable to fit a variety of types and sizes of boats. The front and rear frames are preferably made with water resistant materials and a rubber-like material may be provided at locations where the supports interface with the boat 12, to serve as a barrier between points of contact between the assemblies and the boat 12. This will protect the boat finish from scratches or other blemishes due to installation of the system 10. In one example, support frames 14 and 16 are lengthwise adjustable, and may extend from between about 28 inches (71 cm) to about 41 inches (104 cm). In addition, the support frames 14 and 16 may comprise adjustable clamps at its ends to secure the supports to the gunnels or other structure of the boat 10, as will be described in more detail hereafter.

Figure 3:
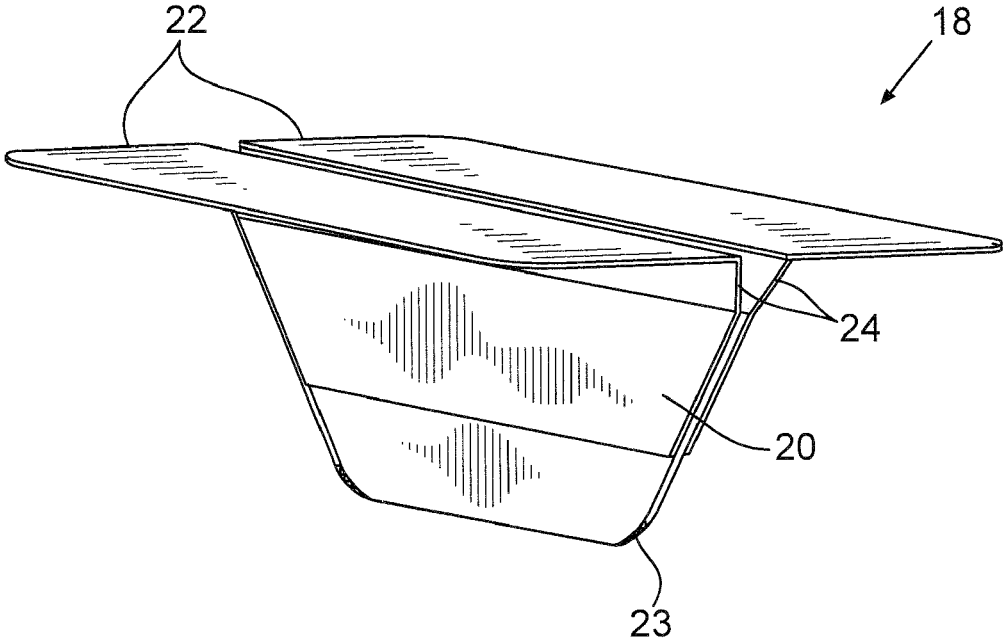
FIG. 3 is a perspective view of the selectively attachable sailing keel of the assembly.

A sailing keel 18 is placed on the underside of canoe 12 and secured in place by a number of straps 21 or other suitable fasteners. Straps 21 may be nylon or other strong and water resistant material. Sailing keel 18 generally extends downward from the bottom of canoe 12 and may be shaped so as to be solidly secured in association with the bottom of the boat, and conform, at least in part, to the typical contour of the bottom of a canoe or other boat. In the example shown in the FIG. 3, sailing keel 18 has a vertical support section 20, secured to a keel board or member 23. The keel member 23 may be formed as a weighted member, which when mounted to the bottom of a boat as indicated, will lower the center of gravity of the boat 12. This facilitates counter balancing the boat against wind forces acting on the sail in a sailing mode. The weighted keel 18 also provides resistance to lateral movement of the boat 12, as well as rolling of the boat 12 from wind forces. This greatly increases the stability of the boat 12 when in a sailing configuration. Further, the configuration of the keel 18 is designed to minimize drag in the water as the boat moves. In this embodiment, the keel member 23 may be separable from the vertical support section 20 of keel assembly 18 to allow repair or replacement without affecting other portions of the assembly 18, but it should be understood that the keel assembly 18 may be formed as a one-piece member if desired. Further, other suitable configurations are contemplated and would be immediately apparent to one of ordinary skill to serve the function of this assembly.

At the upper portion of vertical section 20 along the length of vertical section 20, is a pair of connecting sections 24 that extend from the vertical section 20 such that they diverge from each other. Connecting sections 24 transition to boat support sections 22, which extend somewhat horizontally to create flanges to be supported on the bottom of the boat 12. As previously indicated, the flanges 22 may also be configured to match or conform somewhat to the shape of the bottom of boat 12. The flanges 22 provide stability and structural integrity for the keel assembly when mounted on the bottom of boat 12. As sections 22 are adapted to mate with the bottom of the boat 12 and make contact therewith, they may be provided with a resilient cushioning layer, such as a rubber-type padding material on the face that contacts the underside of canoe 12 and protects the finish thereof as well as resisting movement of the flanges 22 relative to the bottom of boat 12.

In one example, sailing keel 18 may be between about 40 inches (102 cm) and about 45 inches (114 cm) long, between about 15 inches (38 cm) and about 20 inches (51 cm) wide, and between about 9 inches (23 cm) and about 12 inches (30 cm) in height. In another example, sailing keel 18 measures 43¾ inches (111 cm) long, 18 inches (46 cm) wide, and 10¼ (26 cm) high. As indicated, the sailing keel may also be weighted to provide stability for the boat in operation. In one example the sailing keel weighs between about 15 pounds (7 kg) and about 20 pounds (9 kg). In another example, the sailing keel weighs about 18 pounds (8 kg).

Sailing keel 18 is secured in place by a number of straps 21 which extend from horizontal sections 22 to support frames 14 and 16. Straps 21 may attach to and extend from the front and rear lateral corners of flanges 22. To facilitate proper securing of the keel assembly 18 to the bottom of the boat 12, the flanges 22 may be provided with retaining structures to ensure the straps 21 do not disengage therefrom. Other suitable fastening arrangements are contemplated in the invention, such as supports which extend upwardly to be supported on the gunnels of boat 12, or a more permanent form of attachment such as screws or the like. As it is desired in this embodiment, to allow the system 10 to be selectively installed and removed when desired, this embodiment also allows for proper support of the keel assembly 18 without modification or defacement of the boat 12.

Also provided in association with the front or main support frame 14, is a mast support assembly 34 for support of a vertical mast 15 for carrying a sail 13. Mast 15 is placed through a mast tube having an aperture 26 in the support 34. In the example shown, mast 15 is placed through mast aperture 26 in conjunction with the main frame 14 so as to position the mast at a predetermined location relative to the keel assembly 18. In the embodiment shown, it is desirable to position the mast 15 at a forward position relative to the keel assembly 18, providing greater stability to the boat 12 in the sailing mode. The positioning of keel assembly 18 and mast 15 also facilitate the use of a rudder system (to be described with reference to FIG. 7), which may be similar to and positioned much like rudders on dedicated sailboats. Mast 15 rests in a mast boot 28 that placed on the floor of boat 12. Mast 15 may be further secured in place to support 34 by a mast collar latch 27.

Figure 4:
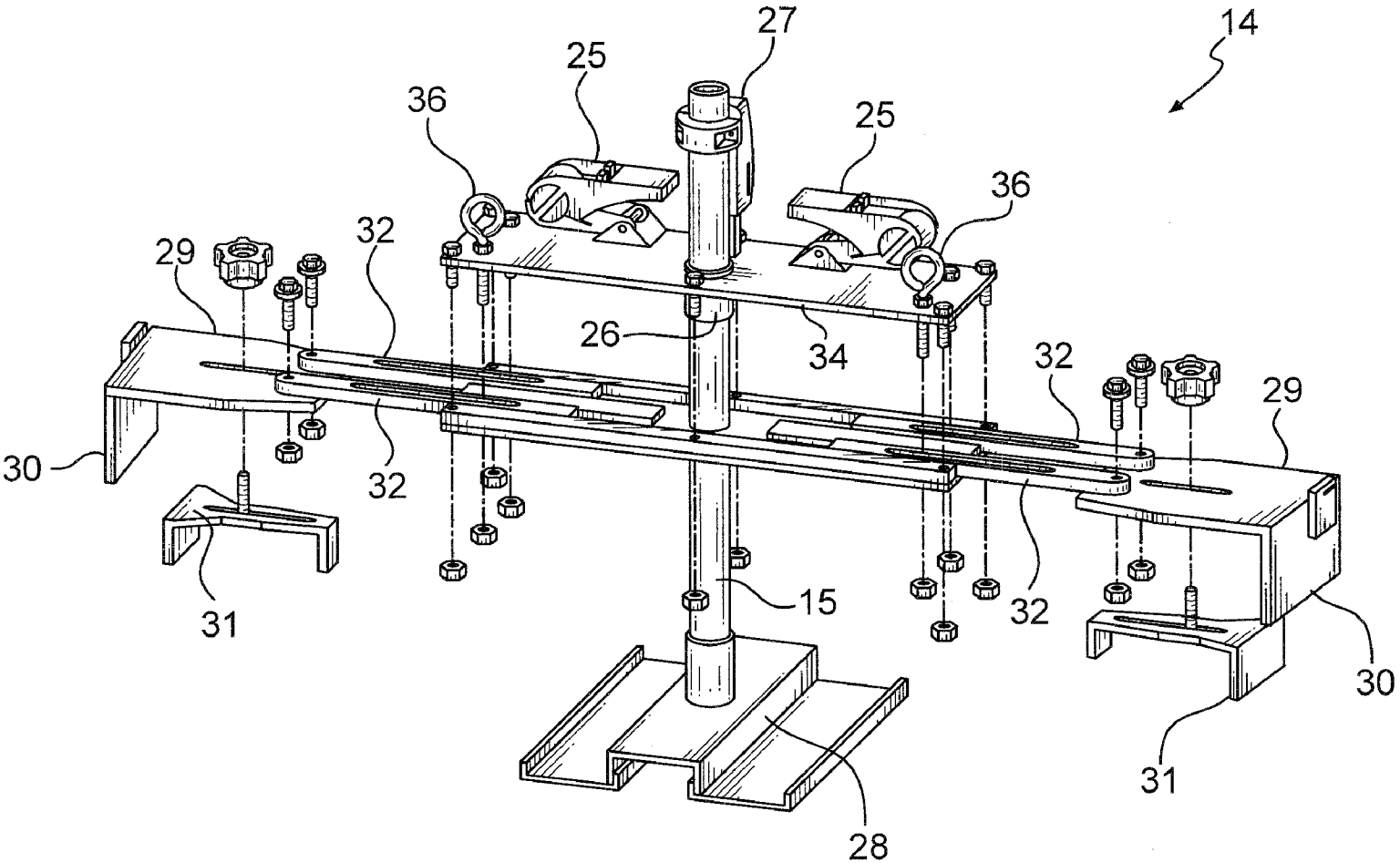
FIG. 4 is an exploded view of the front support frame of the assembly.

Turning now to the structure of support frames 14 and 16, front support frame 14 is shown in more detail in FIG. 4. As mentioned above, support frame 14 extends through or over the interior of boat 12 from one side of the boat to the other. Similarly, supports 14 and 16 extend across a first upper edge located on one side of boat 12 to a second upper edge located on an opposite side of the boat. In one example, front support frame 14 is adjustable to fit a boat across a width of between about 28 and about 41 inches. In another example, front support frame 14 is adjustable to fit a boat across a width of between about 28 and about 38 inches, or can be of suitable dimensions for other widths.

Support frame 14 contains outer frame members 29. An outer clamp member 30 is provided in association with and extends downward from the outer edge of each outer frame member 29. In use, outer clamp members 30 are disposed on the exterior of the sides of boat 12 to secure support frame 14 to the sides of the boat, allowing support frame 14 to rest on the gunnels 17 of boat 12. Inner clamp members 31 may be adjustably attached to outer frame member 29 and placed in contact with the inner surface of boat 12 at gunnels 17, thereby securing support frame 14 to boat 12. In the example shown, inner clamp members 31 are slideably attached to support frame member 29 of frame assembly 14.

Figure 5:
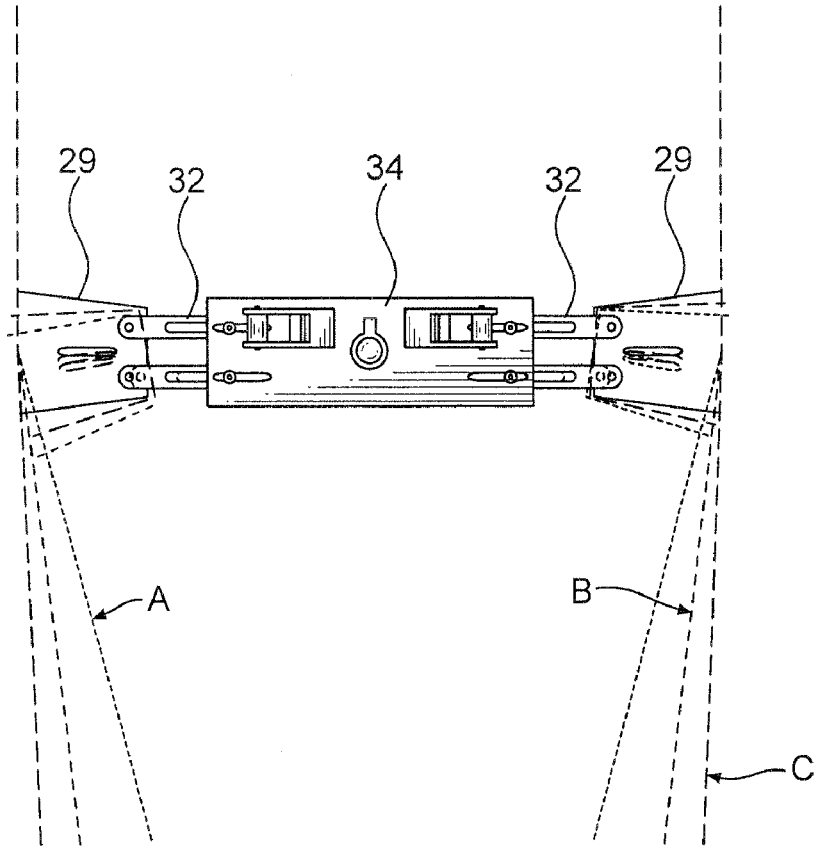
FIG. 5 is a schematic view of the front support frame relative to the side profiles of different sizes and styles of boats.

Also attached to outer frame member 29, are one or more middle frame members 32. Middle frame members may be adjustably attached to outer frame members 29 to permit mounting of outer frame members 29 on gunnels 17 at different angles, so as to accommodate different types of boats and their corresponding dimensions. In one configuration, outer clamp members 30 carried by outer frame member 29 are essentially parallel to each other to accommodate a jon boat or a V-bottom skiff. In another configuration, outer frame members 29 are angled to accommodate the converging sides of a canoe. The angles of outer frame members 29 may also be adjustable to accommodate different models and lengths of canoes. FIG. 5 shows front support frame 14 relative to the profiles of the sides of a shorter canoe A, a longer canoe B, and a skiff C for example. Furthermore, middle frame members 32 may be provided in various lengths to accommodate a wider range of boat widths.

Figure 6:
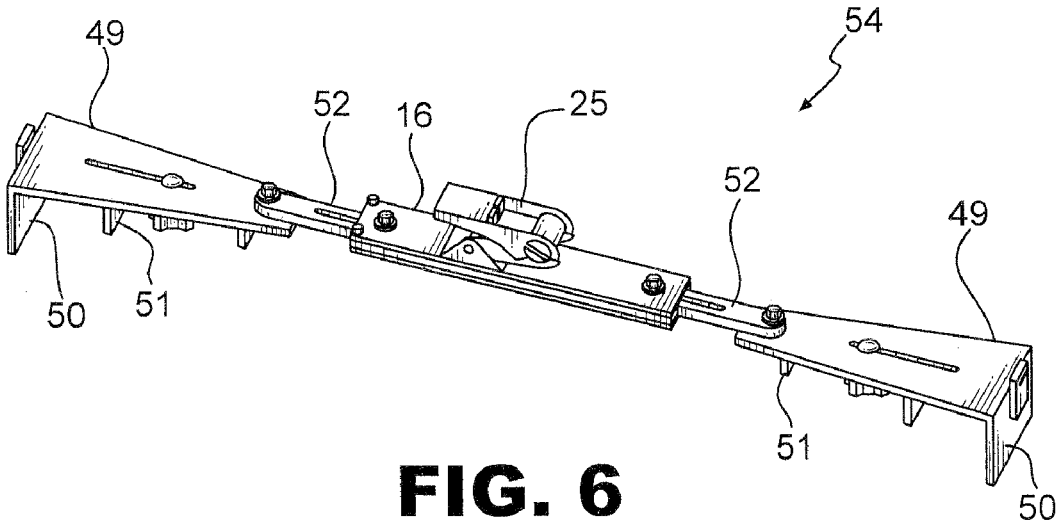
FIG. 6 is a perspective view of the rear support frame of the assembly.

Middle frame members 32 are attached, preferably adjustably attached, to the mast support frame member 34. Adjustable attachment of middle frame members 32 to mast support member 34 allows for further adjustment of the front support frame 14 to accommodate different sizes and types of boats. Mast support member 34 contains a mast tube and aperture 26 and a mast collar latch 27, as mentioned above. Mast support member 34 also carries strap-securing members 25, which may be hand ratchets as shown in FIG. 4–6. The use of hand ratchet devices may facilitate installation and removal of the system 10 to and from a boat, or other suitable strap securing and tightening mechanisms are contemplated. Straps 21 are attached to frame 14 by strap-securing members 25. Mast support member 34 may also carry securing members 36 for the attachment of rigging (not shown) associated with the sail 13.

Rear support frame 16 may be of similar in structure to front support frame 14, but does not have a mast support system associated therewith. Support frame 16 extends through or above the interior of boat 12 from one side of the boat to the other. In one example, rear support frame 16 is adjustable to fit across a width of between about 28 inches (71 cm) and about 41 inches (104 cm). In another example, rear support frame 16 is adjustable to fit across a width of between about 31 inches (79 cm) and about 40 inches (102 cm).

As shown in FIG. 6, support frame 16 contains outer frame members 49. An outer clamp member 50 is associated with and extends downward from the outer edge of each outer frame member 49. In use, outer clamp members 50 are disposed on the outside of boat 12 to removably secure support frame 16 to the sides of the boat, allowing support frame 16 to rest on the gunnels 17 of boat 12. Inner clamp members 51 may be adjustably attached to outer frame member 49 and in use are placed in contact with the inner surface of boat 12 at gunnels 17, thereby removably securing support frame 16 to boat 12. In the example shown, inner clamp members 51 are slideably attached to outer frame member 49.

Also attached to each outer frame member 49, is one or more middle frame members 52. Middle frame members 52 may also be adjustably attached to outer frame members 49 to permit mounting of outer frame members 49 on gunnels 17 on different angles to accommodate different types of boats and their corresponding dimensions, as described above. As with middle support members 32, middle frame member 52 may be provided in varying lengths to accommodate boats of differing widths.

Middle frame members 52 are attached, preferably adjustably attached, to an inner frame member 54. Adjustable attachment of middle frame members 52 to inner frame member 54 allows for further adjustment of the rear support frame 16 to accommodate different sizes and types of boats. When front support frame 14 contains a mast aperture 26, no mast aperture is required on rear support frame 16. Inner frame member 54 of rear support frame 16 may carry one or more strap securing members 25, which may be a hand ratchet as shown in FIG. 6. Straps 21 from either side or both sides of boat 12 may be attached to frame 16 by strap-securing member(s) 25.

Figure 7:
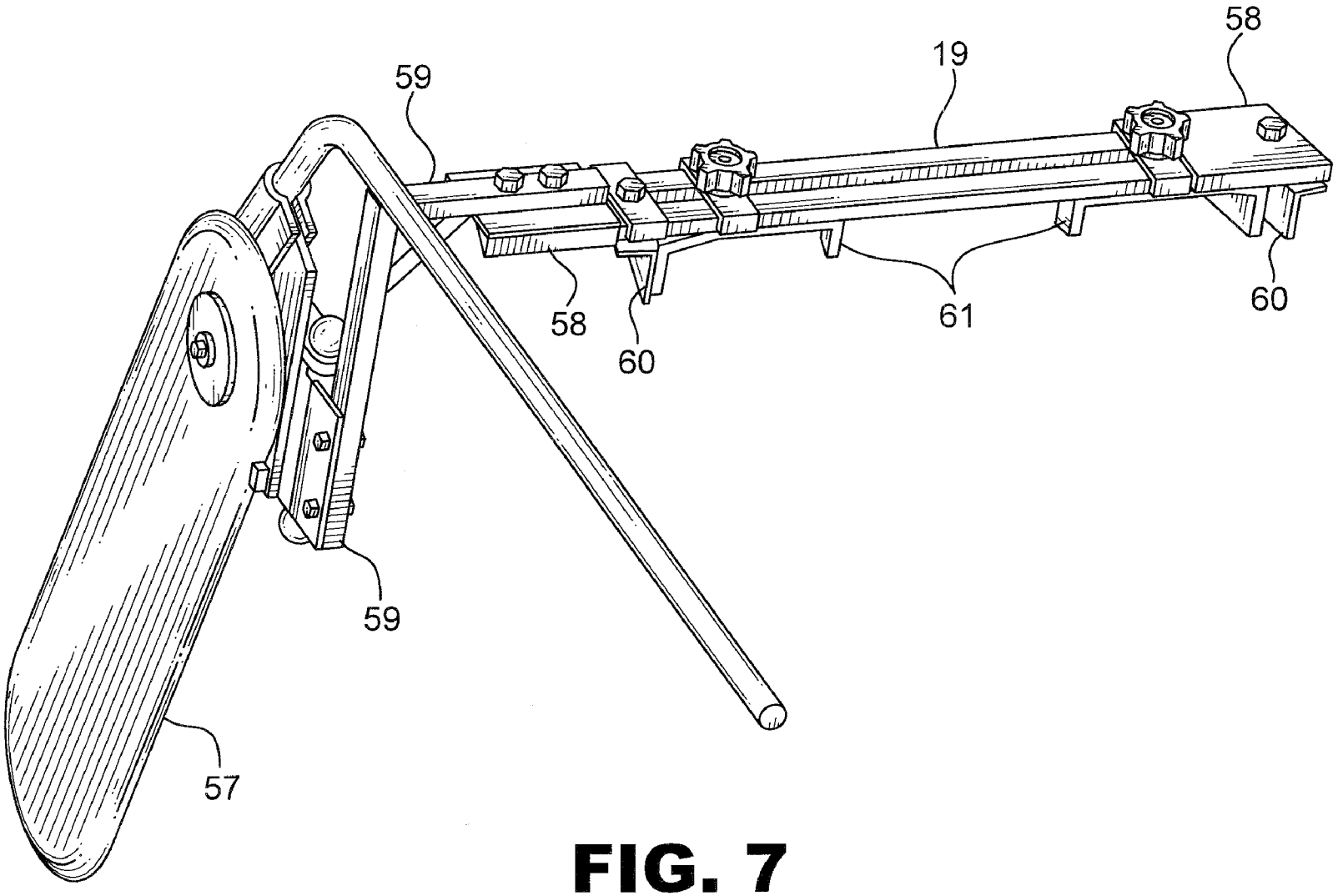
FIG. 7 is a perspective view of the steering support frame of the assembly.

The assembly may also include a steering system that includes a rudder 57 as shown in FIG. 7. Such a steering device may include a steering support frame 19 removably attached to the sides of the boat, preferably at the gunnels of canoes or similar boats, or the sterns of jon boats, skiffs or the like. Like front and rear support frames 14 and 16, steering support frame 19 is also preferably adjustable to fit a variety of types and sizes of boats. Steering support frame 19 includes an outer frame sections 58, which support outer clamp members 60, and a rudder bracket 59. The outer clamp members 60 extend downwardly from outer frame section 58. In use, outer clamp members 60 are disposed on the outside of boat 12 to removably secure steering support frame 19 to the sides of the boat, allowing support frame 19 to rest on gunnels 17 or the stern of a boat 12. Inner clamp members 61 may be adjustably attached to frame 19. In use, inner clamp members 61 are removably placed in contact with the inner surface of boat 12 at gunnels 17 or the stern area, thereby securing steering support frame 19 to boat 12. In the example shown, inner clamp members 61 are slideably attached to support frame 19.

Rudder bracket 59 extends from frame 19 over either side of boat 12. The rudder can thus be placed in a desired position for any user. A rudder 57 is attached to rudder bracket 59 in a spaced position relative to the side of boat 12, in such a way as to provide side-to-side movement of the rudder, so as to steer boat 12 and to provide for tilting of rudder 57 during beaching of boat 12 or to avoid submerged obstacles. Such attachments are known in the art and are therefore not described in further detail herein.

Based upon the foregoing disclosure, it should now be apparent that the assembly of the present invention will selectively convert a small non-sailing watercraft to a sailboat. While the example provided above shows the use of the assembly with a canoe, it should be understood that the assembly may also be used with other types of boats. Furthermore, it should also be understood that the length of the support frames may be adjustable using other arrangements of structures than those portrayed in the example. Finally, while it is preferred that the assembly be adjustable to fit a variety of styles and sizes of boats, such adjustability is not required. The assembly of the present invention may also be constructed such that it only fits a single size or type of boat. It is, therefore, to be understood that any variations evident fall within the scope of the claimed invention and thus, the selection of specific component elements can be determined without departing from the spirit of the invention herein disclosed and described.

I claim:

1. An assembly for converting a canoe to a sailboat, the assembly comprising:

a sailing keel removably attached substantially centrally under a bottom of a canoe;

at least one support frame, wherein the support frame is selectively attached to the canoe and extends across a first upper edge located on one side of the canoe to a second upper edge located on an opposite side of the canoe, and wherein at least one support frame supports a mast in an essentially vertical position the at least one support frame further comprising a mast-seating device, wherein the mast-seating device is placed on the bottom of the canoe;

a steering support frame selectively attached to the canoe; and a rudder attached to the steering support frame.

2. The assembly of claim 1, additionally comprising a mast and a sail.

3. The assembly of claim 1, wherein the at least one support frame is adjustable in length.

4. The assembly of claim 1, wherein the sailing keel is selectively attached to the canoe by straps connected to the sailing keel.

5. The assembly of claim 1, wherein the at least one support frame includes an adjustable clamp mechanism to attach to canoes of differing dimensions.

6. The assembly of claim 1, wherein the at least one support frame includes a first and second support frames provided in spaced relationship to one another, wherein the sailing keel is selectively attached to the canoe by means of the first and second support frames.

7. A method of converting a non-sailing boat to a sailboat, the method comprising:

providing a sailing keel removably attached substantially centrally under a bottom of a non-sailing boat;

providing at least one support frame, wherein the support frame is selectively attached to the boat and extends across a first upper edge located on one side of the boat to a second upper edge located on an opposite side of the boat and supports a mast in an essentially vertical position the at least one support frame further comprising a mast-seating device, wherein the mast-seating device is placed on the bottom of the boat;

providing one or more fasteners for connecting the sailing keel to the keel of the boat;

providing a steering support frame selectively attached to the boat, wherein the steering support frame carries a rudder;

attaching the at least one support frame and the steering support frame to a non-sailing boat;

attaching the sailing keel to the keel of the non-sailing boat by attaching the one or more fasteners to the sailing keel and boat;

securing a mast into the support frame; and securing a sail to the mast to provide a converted sailboat.

8. The method of claim 7, wherein the at least one support frame includes a first and second support frames attached to the boat at the gunnels, for supporting the sailing keel.

9. The method of claim 8, wherein straps are adjustably connected to the sailing keel and to one of the first and second support frames.

10. The method of claim 7, wherein the non-sailing boat is selected from the group consisting of canoes, rowboats, kayaks and V-bottomed skiffs.

11. A boat conversion kit comprising:

a sailing keel removably attachable substanially centrally under a bottom of the boat;

a first and a second support frame, removably attachable to and extending across a first upper edge located on one side of the boat to a second upper edge located on an opposite side of the boat, wherein one of the support frames supports a mast in an essentially vertical position;

one or more straps connected on a first end to the sailing keel and connected on a second end to at least one of the first and second support frames;

a steering support frame selectively attachable to a boat; and a rudder attached to the steering support frame.

12. The boat conversion kit according to claim 11, additionally comprising a mast secured to a support frame.

13. The boat conversion kit according to claim 11, wherein the first and second support frames and the steering frame are removably attached to the boat at the gunnels.

* * * * *